US005957388A

United States Patent [19]

Franz

[11] Patent Number: 5,957,388

[45] Date of Patent: Sep. 28, 1999

[54] CONTAINER FOR FLOWABLE CLEANING AGENT, SPECIFICALLY ELASTIC BOTTLE FOR LIQUID THIXOTROPIC WC BOWL CLEANER

[75] Inventor: Dieter Franz, Wentorf, Germany

[73] Assignee: Yankee Polish Luth GmbH & Co., Reinbek, Germany

[21] Appl. No.: 08/809,280

[22] PCT Filed: Jul. 12, 1996

[86] PCT No.: PCT/EP96/03064

§ 371 Date: May 5, 1997

§ 102(e) Date: May 5, 1997

[87] PCT Pub. No.: WO97/03892

PCT Pub. Date: Feb. 6, 1997

[30] Foreign Application Priority Data

Jul. 17, 1995 [DE] Germany ..... 195 25 988

[51] Int. Cl.[6] ..... B05B 1/14

[52] U.S. Cl. ..... 239/327; 239/552; 239/567; 215/346

[58] Field of Search ..... 239/327, 552, 239/567; 222/215, 201; 215/216, 317, 323, 346

[56] References Cited

U.S. PATENT DOCUMENTS

| | | | |
|---|---|---|---|
| 2,383,433 | 8/1945 | Burnam | 299/143 |
| 2,492,037 | 12/1949 | Freeman et al. | 261/116 |
| 2,825,603 | 3/1958 | Altengott | 239/327 |
| 2,840,277 | 6/1958 | Bach | 222/215 X |
| 2,967,261 | 6/1961 | McCuiston et al. | 239/327 X |
| 3,583,602 | 6/1971 | Gruber | 222/215 X |
| 5,269,445 | 12/1993 | Tobler | 222/211 |

FOREIGN PATENT DOCUMENTS

| | | | |
|---|---|---|---|
| 566301 | 10/1993 | European Pat. Off. | 222/215 |
| 1044937 | 11/1951 | France | 222/215 |
| 1069363 | 7/1954 | France . | |
| 1163220 | 9/1958 | France . | |
| 1951871 | 12/1966 | Germany . | |
| 1579131 | 11/1980 | United Kingdom | 222/215 |

*Primary Examiner*—Kevin Weldon
*Attorney, Agent, or Firm*—Ladas & Parry

[57] ABSTRACT

The invention relates to a container for flowable cleaner products, particularly for liquid thixotropic WC bowl cleaners of which the thixotropic properties cause the liquid WC bowl cleaner to adhere to vertical surface. It is the object of the invention to provide a container having a spray head which causes the flowable cleaner product, and particularly the afore-said WC bowl cleaner, to be distributed in an optimum manner and which at the same time can be sealed and closed in a child-proof manner. To this end, the container is equipped with a spray head which consists of a cylinder-like basic body and of a mandrel-like body having a plurality of spray orifices, with the geometry and the relative arrangement of the cylinder-like and mandrel-like bodies being such as to enable the required optimum distribution to be obtained, with a special design of the closure cap providing for child-proof sealing and a releasable engagement thereof with the spray head.

11 Claims, 1 Drawing Sheet

CONTAINER FOR FLOWABLE CLEANING AGENT, SPECIFICALLY ELASTIC BOTTLE FOR LIQUID THIXOTROPIC WC BOWL CLEANER

BACKGROUND—FIELD OF THE INVENTION

The invention relates to a container for a flowable cleaning agent and specifically to an elastic bottle for a liquid thixotropic WC bowl cleaner comprising a spray head at the container mouth and having at least one spray orifice communicating with the interior of the container, as well as a closure cap extending over and covering the spray head and releasably engaging the container.

BACKGROUND—DESCRIPTION OF THE PRIOR ART

There have been known aerosol containers having a cap-like spray head (German Utility Model 1,949,691) including a wall portion or panel on which pressure must be exerted to open a valve disposed inside the aerosol container. Accordingly, an aerosol container can comprise a distributor head having a plurality of discharge opening therethrough, a wall panel disposed between said distributor head and a valve inside the container and extenting in parallel with the container bottom, and a feed conduit extending between the container valve and the distributor head having said discharge openings distributed over all of its surface, said feed conduit being coaxial with the valve axis and the wall or panel to be actuated for opening and closing the container valve being formed as a portion of a sealing disk.

Also known is a water sprinkler system comprising a sprinkler plate which has a plurality of spinkler orifices therethrough and forms the cover of a funnel-shaped housing connected with a water inlet, wherein a plurality of spherical bodies is arranged to interrupt the stream of water exiting through the sprinkler orifices so as to generate a continuously changing sprinkling pattern. (WA 88/00497).

SUMMARY OF THE INVENTION

The invention relates particularly to the state of the development of liquid WC bowl cleaner products.

In addition to tensides, the acidic liquid WC bowl cleaners known to date essentially contain organic acids (such as formic acid, acetic acid, citric acid, maleic acid; lactic acid, tartric acid, etc.) or inorganic acids (such as phosphoric acid and hydrochloric acid), as well as polysaccharides as thickening agents. In particular, the inorganic acids and formic acid are potentially hazardous because of their etching effect and should not be used for household cleaners. The use of acetic acid is limited by its pungent odor. The viscosity generated by the thickening agents is supposed to get the acidic cleaner to act also on vertical surfaces in a WC bowl for as long a time as possible.

As the viscosity of the WC bowl cleaner cannot be increased to any level desired (its capacity to dissolve calcareous deposits decreases with increasing viscosity) because it would become increasingly difficult to distribute the product, the time for which the calcareous deposit-dissolving components of the WC bowl cleaner can exert their effect is limited, and so is their effective concentration.

The thixotropic characteristics of the liquid WC bowl cleaner cause the liquid to adhere to vertical surfaces; the resultant requirement of an adequate distribution of the product gives rise to the object underlying the invention, namely, to design a container for flowable cleaners, particularly a bottle for liquid thixotropic WC bowl cleaners in accordance with the preamble of claim 1 which provides for the optimum distribution of sufficient quantitites of the product while it allows the spray head of the container to be sealed in a child-proof manner.

In accordance with the invention, the spray head comprises a cylinder-like basic body which extends from the container and of which the bottom end is connected with the container while its wall at the free top end flares in a substantially convex-like manner, relative to the central axis of the spray head, and a mandrel-like body disposed within said cylinder-like basic body in its upper section and symmetrical to its central axis, said mandrel-like body being connected at its bottom end to the inne wall of the cylinder-like basic body and arranged over its longitudinal extent in a spaced relationship to the inner wall of the cylinder-like basic body. The spherically shaped end wall of said mandrel-like body has therethrough a plurality of spray orifices of which the direction of discharge is perpendicular to the spherical surface of the top end of the mandrel-like body and of which the zenith lies at a distance (d) below the plane which includes the top end of the ourwardly flared wall of the cylinder-like basic body. The closure cap is adapted to be placed in releasable engagement with the spray head.

Advantageous further developments of the inventive container are disclosed in claims 2 to 11.

The spray head comprising the cylinder-like basic body and the mandrel-like body integrally connected therewith is advantageously fabricated by injection molding and to be replaceably fitted into the container mouth. The special inventive configuration and relative arrangement of the cylinder-like basic and of the mandrel-like bodies (the spherical surface of the latter preferably includes four spray orifices spaced 90° apart) ensure the optimum distribution of a product such as a liquid thixotropic WC bowl cleaner as it is sprayed on the inner walls of a WC bowl. Being designed especially to accommodate the spray head of the container, the closure cap provides for an adequate sealing of the container filled with a flowable cleaner product while its removal is not unduly difficult for adults.

The invention will now be explained in greater detail under reference to the drawings.

DESCRIPTION OF THE PREFERRED EMBODIMENT

Figure 1:
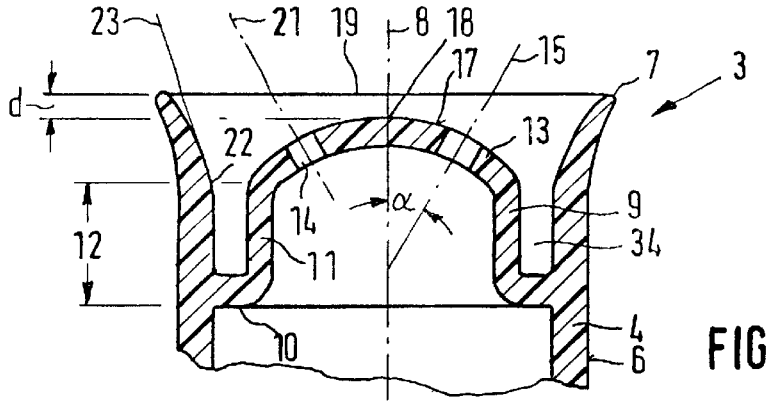
FIG. 1 is an elevation in section of the planar portion of the cylinder-like basic body and of the mandrel-like body integral therewith.
Figure 2:
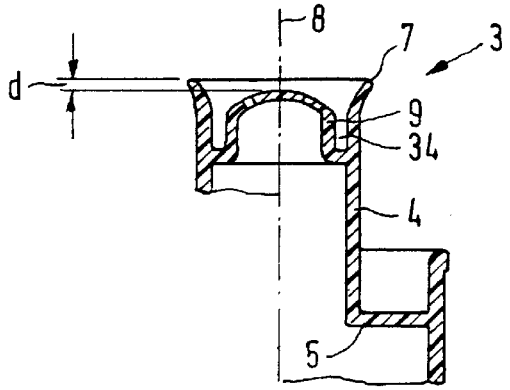
FIG. 2 is an elevation in section of the spray head partly broken away and showing the step-like configuration at its bottom end.
Figure 3:
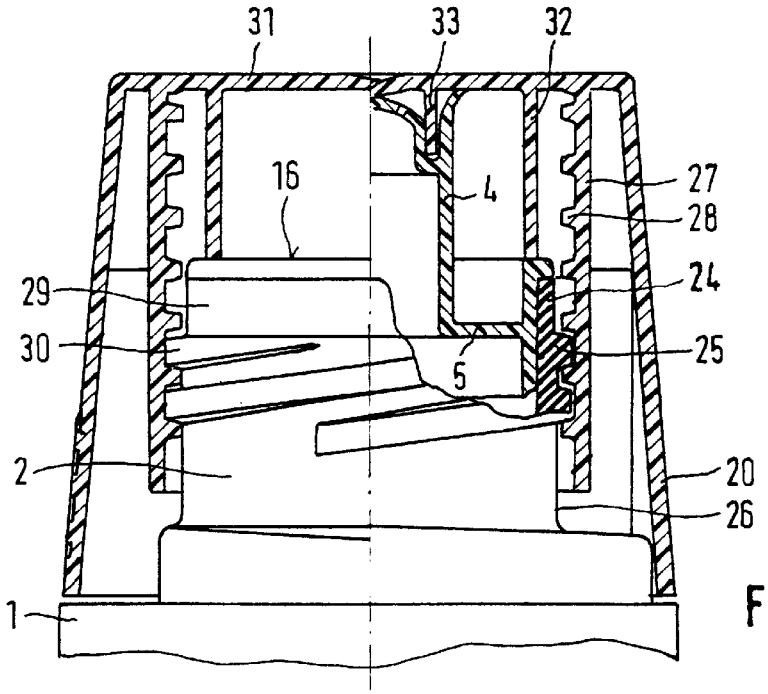
FIG. 3 is an elevation in section of the container mouth with the spray head removably inserted and the closure cap engaging the latter and removably engaging the container mouth.

As showin in FIGS. 1 to 3, a container 1 for a flowable cleaning agents, particularly for a liquid thixotropic WC bowl cleaner, comprises a spray head 3 removably fitted in container mouth 2 (FIG. 1). As shown mos clearly in FIGS. 1 and 2, spray head 3 has a cylinder-like basic body 4 and, formed integral therewith, a mandrel-like body 90. The bottom end 5 of cylinder-like basic body 4 is outwardly stepped and wall 6 of basic body 4 is outwardly flared in a convex-like manner—relative to the central axis 8 of spray head 3—at the free top end 7.

Mandrel-like body 9 is disposed in the upper portion of cylinder-like basic body 4, is symmetrical with central axis 8 thereof, is spaced along its longitudinal extent 12 from the inner wall surface 11 of cylinder-like body and, in the embodiment of spray head 3 shown in FIGS. 1 to 3, has its bottom end 10 provided integral with inner wall 11 of basic body 4. It is possible also to attach mandrel-like body 9 releasably to basic body 4. In the embodiment shown, the spherical end 13 of mandrel-like body 9 has four spray orifices 14 therethrough which are mutually spaced 90° and of which the direction of fluid passage 15 is perpendicular to spherical surface 17 of the top end 13 of mandrel-like body 9. For an optimum distribution of the WC bowl cleaner product discharged from discharge orifices 14, the angle of inclination $\alpha$ of the central axis 21 of spray orifices 14 to central axis 8 of cylinder-like basic body 4 is so related to the radius of the outwardly convexly flared inner wall 11 of cylinder-like basic body that—seen in a longitudinal section through spray head 3 (FIG. 1)—the central axis 21 of each spray orifice 14 is parallel to a line 23 tangent to each starting point 22 of the outwardly convexly flared inner wall 11 of cylinder-like basic body 4. As shown most clearly in FIGS. 1 and 2, zenith 18 of mandrel-like body 9 must be spaced a distance d below the plane 19 which includes top end 7 of the outwardly convex wall 6 of cylinder-like basic body 4. Preferably this distance d is smaller than 1 cm and amounts to approximately 1/7 of the longitudinal extent 12 of mandrel-like body 9.

As shown in FIG. 3, wall 6 of cylinder-like basic body 4, which is stepped outwardly at its bottom end 5, has outer threads 24 adapted to engage inner threads 25 on inner wall 26 in the container mouth so that spray head 3 can be replaced at will.

A closure cap 20 (FIG. 3), which may be fabricated by injection molding, has along an inner wall 27 threads 28 adapted to be releasably engaged with threads 30 on outer wall 29 of container mouth 2. Holding elements (32, 33) extend vertically down from end wall 31 of the closure cap; in the sealing position of cap 20, they extend into a groove-like interspace 34 between inner wall 11 of basic body 4 and mandrel-like body 9 (see FIG. 3) to engage, and frictionally lock with, the stepped bottom end 5 of cylinder-like basic body 4 to form a plug-in seal which is both releasable and child-proof.

I claim:

1. A container having an interior cavity for holding a flowable substance, a mouth portion in communication with said interior cavity, a spray head attached to said mouth portion, said spray head comprising a lower end attached to said mouth portion, a hollow cylindrical body portion having a central axis attached to said lower end, the cylindrical body portion having an interior surface, said hollow cylindrical body portion also having an upper end attached to said hollow cylindrical body portion, said upper end flaring outwardly away from the central axis and terminating in a lip, said spray head also comprising an inner portion disposed within said hollow cylindrical body portion, said inner portion having a longitudinal central axis coincident with the outer portion central axis, a bottom end attached to the cylindrical body interior surface, a hollow body attached to said bottom end, a top end attached to said inner portion hollow body, said top end having a spherical outer surface, said top end having at least one spray orifice extending therethrough in a direction perpendicular to said spherical outer surface, said at least one spray orifice being in communication with said interior cavity, said spherical outer surface projecting toward said outer portion lip to a predetermined distance below said outer portion lip; and a closure cap adapted for releasable engagement with said spray head and for covering said spray head.

2. The container according to claim 1 wherein said outer hollow cylindrical body portion and said inner portion of said spray head are formed integral with each other.

3. The container according to claim 2, wherein said spray head is releasably connected to said container.

4. The container according to claim 1, wherein said top end of said inner portion includes four spray orifices spaced 90° apart.

5. The container according to claim 1, wherein said predetermined distance to which said spherical outer surface projects below said outer portion lip is smaller than 1 cm and amounts to approximately 1/7 of the longitudinal extent of said inner portion.

6. The container of any one of claims 1, 2, 3, 4 or 5, wherein an angle at which at least one spray orifice extends through said inner portion top end with respect to the outer portion central axis, is adjusted with respect to the curvature of the outwardly flaring outer hollow cylindrical body portion upper end, such that said flowable substance is distributed in an optimum manner as it is sprayed into a receptacle.

7. The container according to claim 6, wherein an angle at which said at least one spray orifice extends through said inner portion top end with respect to the outer portion central axis, is parallel to a line tangent to the respective starting point of the outwardly flaring upper end of said spray head outer portion.

8. The container according to claim 7, wherein said container mouth portion further comprises an inner surface, said inner surface including internal threads, and said lower end of said spray head outer portion is outwardly stepped and has external threads adapted to engage said internal threads on said mouth portion inner surface.

9. The container according to claim 8, wherein said container mouth portion further comprises an outer surface, said outer surface including external threads, said closure cap further comprises a threaded portion, said threaded portion including internal threads adapted to engage said external threads on said mouth portion outer surface, and wherein said closure cap further comprises a top end wall and holding means extending vertically down from said top end wall to releasably engage the stepped lower end of said spray head outer portion for forming a sealing means between said spray head and said closure cap.

10. The container according to claim 1, wherein said container is fabricated by injection molding.

11. The container according to claim 1 wherein said spray head is fabricated by injection molding.

* * * * *